United States Patent [19]

Mosch

[11] Patent Number: 4,736,972

[45] Date of Patent: Apr. 12, 1988

[54] CHECK RAIL LOCK

[75] Inventor: Duane L. Mosch, Owatonna, Minn.

[73] Assignee: Turth Incorporated, Owatonna, Minn.

[21] Appl. No.: 821,004

[22] Filed: Jan. 22, 1986

[51] Int. Cl.[4] ..... E05C 3/04

[52] U.S. Cl. ..... 292/204; 74/548; 292/209; 292/241; 292/DIG. 47; 292/DIG. 61

[58] Field of Search ..... 292/241, 204, 209, 103, 292/107, DIG. 61, 353, DIG. 7, DIG. 20, DIG. 47, DIG. 33, DIG. 35, 202; 70/422; 411/554, 555, 349, 517, 519; 24/590, 593, 594, 595, 453; 74/548

[56] References Cited

U.S. PATENT DOCUMENTS

| | | | |
|---|---|---|---|
| 423,761 | 3/1890 | Hasenpflug | 292/241 |
| 952,277 | 3/1910 | Pilarski | 292/204 |
| 1,139,575 | 5/1915 | Pitsch | 292/241 |
| 1,203,980 | 11/1916 | Clarke | 24/594 X |
| 1,575,330 | 3/1926 | Goodman | 70/216 |
| 2,258,617 | 10/1941 | Knauff | 292/241 |
| 3,119,591 | 1/1964 | Malecki | 403/96 X |
| 3,135,542 | 6/1964 | Wilkinson | 292/204 |
| 3,811,718 | 5/1974 | Bates | 292/241 |
| 3,951,444 | 4/1976 | Shull | 292/204 X |
| 4,436,328 | 3/1984 | Chernosky | 292/67 |

FOREIGN PATENT DOCUMENTS

| | | | |
|---|---|---|---|
| 330696 | 8/1903 | France | 24/594 |
| 837452 | 6/1960 | United Kingdom | 411/349 |

OTHER PUBLICATIONS

Truth Incorporated revised Part No. drawings, 45005 and 45020, bearing dates of 9-19-80 and 10-17-84, respectively.

*Primary Examiner*—Lloyd A. Gall
*Attorney, Agent, or Firm*—Wood, Dalton, Phillips, Mason & Rowe

[57] ABSTRACT

A check rail lock having a housing with an interior space rotatably mounts a shaft connected to a handle and a cam and with stop members associated with the cam and the housing for limiting rotation of the cam between locked and unlocked positions. The cam is releasably held in either of these positions by mounting of a spring washer on the shaft to which the cam is fixed, and with the spring washer and the housing having coacting detent structure which releasably holds the cam in either the locked or unlocked position.

4 Claims, 1 Drawing Sheet

CHECK RAIL LOCK

BACKGROUND OF THE INVENTION

This invention pertains to a check rail lock for use with a double-hung window for drawing together the meeting rails of an upper and a lower sash of the double-hung window, and locking the sash against opening movement. The check rail lock has a housing which mounts a rotatable cam for movement between locked and unlocked positions and which engages a keeper in a locked position and there is coacting structure for limiting movement of the cam to movement between locked and unlocked positions and a spring washer rotatable with the cam and coacting detent structure on the spring washer and the housing for releasably retaining the cam in either locked or unlocked position.

A check rail lock of the general type disclosed herein is well known in the art. A housing mountable on one window sash has a rotatable cam therein for movement between locked and unlocked positions relative to a keeper mounted on the other sash and with a handle disposed exteriorly of the housing for rotating the cam. In a check rail lock of this type, it is also known to have structure for limiting the rotation of the cam and handle for movement between locked and unlocked positions of the cam and to have spring means for releasably retaining the cam in either locked or unlocked position.

The Bates U.S. Pat. No. 3,811,718 discloses a sash lock for double-hung windows wherein the handle and cam can rotate between a pair of stops fixed to a housing of the lock and a spring member supported by the housing functions to releasably hold the cam in either locked or unlocked position.

A check rail lock having an appearance generally similar to that disclosed herein is shown in the Anderson U.S. Pat. No. Des. 268,643.

A window lock having a cam with a square opening fitted to a shaft with a square section is shown in Chernosky, U.S. Pat. No. 4,436,328.

In order to manufacture and sell a check rail lock at the least possible cost, it is important to have the structure as simple as possible and require a minimal number of assembly steps. The invention disclosed herein is an improvement over the prior art in these respects.

SUMMARY OF THE INVENTION

A primary feature of the invention is to provide a new and improved check rail lock having components mountable on the meeting rails of the upper and lower sash of a double-hung window and which provides for positive alignment of the meeting rails and locking thereof by rotation of a cam which coacts with a keeper and with the cam being located and releasably held in either locked or unlocked position by a relatively simple, easily assembled structure.

More particularly, the check rail lock has a cam fixed to a shaft integral with a handle and which is rotatably mounted within a tubular section of the housing of the check rail lock for movement between locked and unlocked positions and a spring washer is positioned between the cam and an exposed end of the housing tubular section and keyed to the shaft for rotation therewith. The spring washer and exposed end of the housing tubular section have coacting detent means as well as there being coacting stop surfaces on the cam and the housing whereby the cam is limited to movement between locked and unlocked positions and the detent means releasably hold the cam in either of said positions.

An object of the invention is to provide a check rail lock having a cam rotatably mounted within a housing by connection to a rotatable shaft integral with a handle and which is rotatably mounted in the housing and with a spring washer also rotatable with the shaft and the spring washer and housing have coacting detent means which releasably hold the cam and handle in either locked or unlocked positions. The spring washer also functions to take up tolerances that may exist between the rotatable shaft and its cam.

Still another object of the invention is to provide a check rail lock:

comprising, a housing, a cam, means rotatably mounting the cam on the housing for rotation between locked and unlocked positions, coacting stop means on the housing and cam for limiting the rotation of the cam to movement between said locked and unlocked positions, a spring washer rotatable with said cam, and coacting detent means on said housing and spring washer for releasably holding the cam in either locked or unlocked position.

A further object of the invention is to provide a check rail lock comprising, a housing with a top wall and an interior space, a tubular section of the housing depending from the top wall into said interior space and having a lower exposed end, a handle having an integral shaft rotatably mounted in said tubular section and with said shaft having a rectangular section beneath the tubular section with a pair of grooves extending axially thereof, a cam fixed to said rectangular section of the shaft and rotatable through movement of the handle between locked and unlocked positions, a spring washer between said tubular section exposed end and the cam and having a pair of tabs positioned one in each of said axially extending grooves to cause rotation of the spring washer with the shaft, a pair of diametrically opposite detent notches in said tubular section exposed end, a pair of diametrically opposite detents on said spring washer engageable in said detent notches when the cam is in either locked or unlocked position, a pair of stop shoulders on the exterior of the tubular section, and a stop member on the cam movable between said stop shoulders as the cam moves between locked and unlocked positions.

BRIEF DESCRIPTIONS OF THE DRAWINGS

DESCRIPTION OF THE PREFERRED EMBODIMENT

Figure 1:
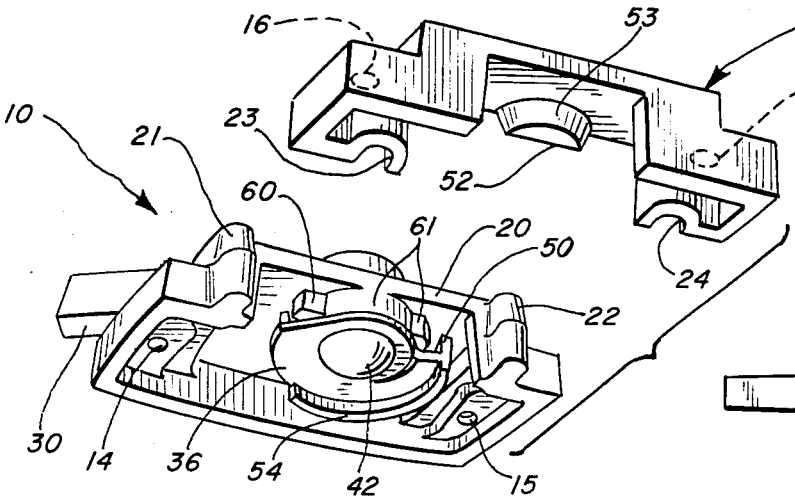
FIG. 1 is a perspective view looking at the underside of the check rail lock housing and keeper which are shown in spaced apart relation.
Figure 6:
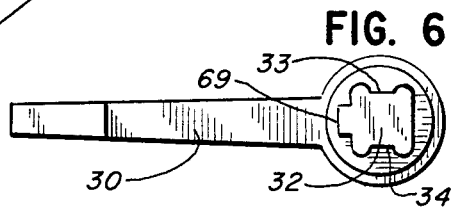
FIG. 6 is a bottom plan view of the handle.

The check rail lock has two primary components as seen in FIG. 1 with one of the components being a housing indicated generally at 10 which mounts the movable structure and the other component being a keeper indicated generally at 12.

The housing 10, which is seen looking toward the underside thereof in FIG. 1, is mounted on the meeting rail of the lower sash of a double-hung window and the keeper 12 is mounted in alignment therewith on the meeting rail of the upper sash. Each of these components can be mounted on their respective meeting rails by fastening means such as screws which can extend through openings 14 and 15 of the housing 10 and openings 16 and 17 of the keeper 12.

The housing 10 has a top wall 20 and an outer face with a pair of vertically extending contoured lugs 21 and 22 which can coact with a pair of similarly shaped recesses 23 and 24 on an inner face of the keeper 12. These lugs and recesses function to bring the housing and keeper into alignment as the meeting rails come together upon closing of the window.

Figure 2:
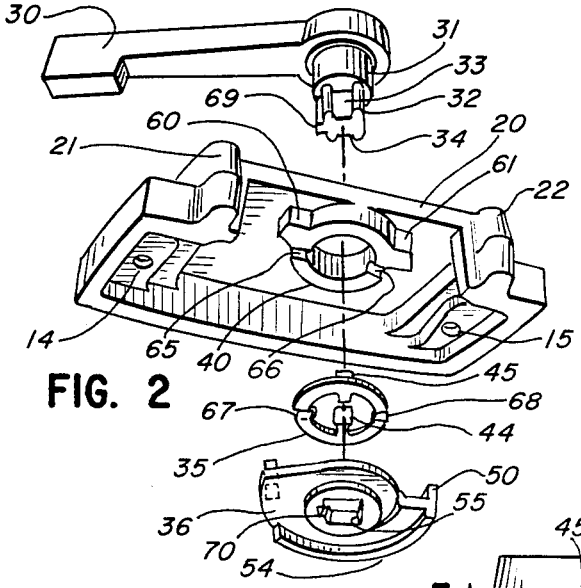
FIG. 2 is a perspective exploded view of the check rail lock housing and associated structure.
Figure 5:
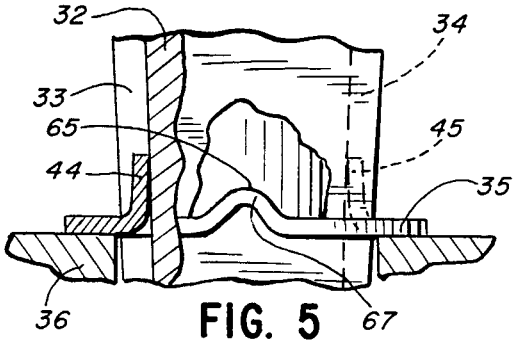
FIG. 5 is a fragmentary sectional view taken generally along the line 5—5 in FIG. 3 and on an enlarged scale.

The structure associated with the housing 10 is shown in the exploded perspective view of FIG. 2 and includes a handle 30 having an integral shaft 31 with a rectangular section 32 at the lower end thereof having a pair of axially extending grooves 33 and 34. Additional movable structure includes a spring washer 35 and a cam 36. Additionally, handle 30 has an orientation lug 69 which positively engages cam 36 at orientation pocket 70 to assure correct assembly location.

Figure 3:
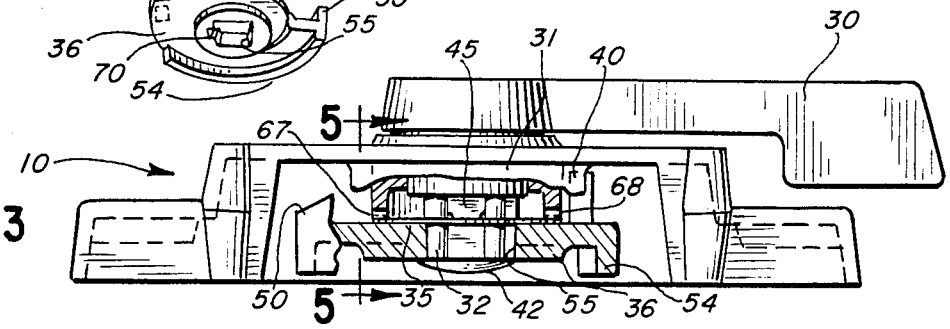
FIG. 3 is an elevational view of the check rail housing and associated structure looking in the direction thereof as seen in FIG. 1 and with the cam in locked position and broken away.

The shaft 31 is rotatably mounted within a tubular section 40 of the housing which depends from the top wall 20 with the rectangular section 32 of the shaft extending below the tubular section 40. The spring washer 35 and the cam 36 are mounted on the rectangular section 32 and these parts are held in assembled relation, as seen in FIG. 3, by means of a spin deformation of an end of the shaft to provide an enlarged rounded end 42.

The spring washer 35 is formed as an annular member to surround the rectangular section 32 of the shaft and has a pair of tabs 44 and 45 formed upwardly from the plane of the spring washer for rotational interlocking relation in the axially extending grooves 33 and 34 whereby the spring washer is caused to rotate with the shaft.

The cam 36 has a raised spiral cam flange 50 which in the unlocked position of the check rail lock is disposed within the interior space of the housing and which can be moved to an engaging position behind a locking member 52 on the keeper having a curved surface 53. A strengthening rib 54 having generally the same curvature as the cam flange 50 extends downwardly from the cam 36. The cam has a square opening 55 for mounting on the rectangular section 32 of the shaft.

Figure 4:
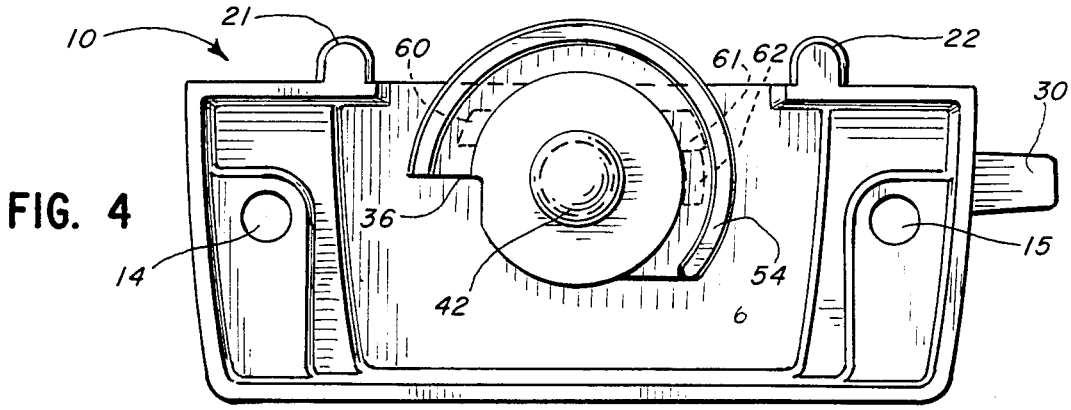
FIG. 4 is a bottom plan view of the structure seen in FIG. 3.

The tubular section 40 of the housing has a pair of stop shoulders 60 and 61 for coaction with a stop member 62 on the upper surface of the cam whereby the stop member coacts with the stop shoulders to limit rotation of the cam between locked and unlocked positions. The coaction between the stop member and stop shoulder 61 is shown in FIG. 4 when the cam is in locked position.

The spring washer 35 and the tubular section 40 of the housing have coacting detent means for releasably holding the cam in either locked or unlocked position. This detent means includes a pair of diametrically opposite detent notches 65 and 66 formed in an exposed lower face of the tubular section 40 and a pair of diametrically opposite detents 67 and 68 deformed upwardly in the annular body of the spring washer and which engage in the detent notches 65 and 66 when the cam 36 is in either locked or unlocked position.

With the check rail lock structure disclosed, the cam can be releasably held in either locked or unlocked position by use of spring means in the form of a spring washer which can be assembled onto the shaft with the cam in a single assembly operation and with the spring washer providing dual functions of tolerance take-up and releasable locking of the cam.

I claim:

1. A check rail lock comprising a housing having a central depending tubular section with an exposed lower end, a cam adjacent the exposed lower end of the tubular section, means including a shaft in said tubular section rotatably mounting the cam on the housing for rotation between locked and unlocked positions, a spring washer between the exposed lower end of the tubular section and the cam and rotatable with said cam, and coacting detent means on said housing and spring washer for releasably holding the cam in either locked or unlocked position including a pair of diametrically opposed detent elements with one of said detent elements being on the exposed lower end of the tubular section and the other detent element being on the spring washer.

2. A check rail lock comprising a housing, a cam, means rotatably mounting the cam on the housing for rotation between locked and unlocked positions including a handle having a shaft rotatable in the housing, said cam being fixed to said shaft for rotation therewith, coacting stop means on the housing and cam for limiting the rotation of the cam to movement between said locked and unlocked positions, a spring washer fixed to said shaft and rotatable with said cam, coacting detent means on said housing and spring washer for releasably holding the cam in either locked or unlocked position, interengaging means on said handle shaft, cam and spring washer to assure correct assembly of said handle shaft to the cam and to the spring washer, said housing having a tubular section defining a bearing for said shaft and said tubular section having a pair of detent notches in an exposed end thereof defining a portion of said coacting detent means, and said spring washer being in engagement with said exposed end and having a pair of detents defining a portion of said coacting detent means and engageable in said detent notches when the cam is in either locked or unlocked position.

3. A check rail lock comprising a housing with a top wall and an interior space, a tubular section of the housing depending from the top wall into said interior space and having a lower exposed end, a handle having an integral shaft rotatably mounted in said tubular section and said shaft having a rectangular section beneath the tubular section with a pair of grooves extending axially thereof, a cam fixed to said rectangular section of the shaft and rotatable through movement of the handle between locked and unlocked positions, a spring washer between said tubular section exposed end and the cam and having a pair of tabs positioned one in each of said axially extending grooves to cause rotation of the spring washer with the shaft, a pair of diametrically opposite detent notches in said tubular section exposed end, a pair of diametrically opposite detents on said spring washer engageable in said detent notches when the cam is in either locked or unlocked position, a pair of stop shoulders on the exterior of the tubular section, and a stop member on the cam movable between said stop shoulders as the cam moves between locked and unlocked positions.

4. A check rail lock comprising a housing with a top wall and an interior space, a tubular section of the housing depending from the top wall into said interior space and having a lower exposed end, a handle having an integral shaft rotatably mounted in said tubular section and said shaft having a rectangular section beneath the tubular section with a pair of grooves extending axially thereof, a cam fixed to said rectangular section of the shaft and rotatable through movement of the handle between locked and unlocked positions, a spring washer between said tubular section exposed end and the cam and having a pair of tabs positioned one in each of said axially extending grooves to cause rotation of the spring washer with the shaft, at least one detent notch in said tubular section exposed end, and at least one detent on said spring washer engageable in said detent notch for releasably holding the shaft and cam against rotation.

* * * * *

UNITED STATES PATENT AND TRADEMARK OFFICE

CERTIFICATE OF CORRECTION

PATENT NO. : 4,736,972

DATED : Apr. 12, 1988

INVENTOR(S) : DUANE L. MOSCH

It is certified that error appears in the above-identified patent and that said Letters Patent is hereby corrected as shown below:

ON THE TITLE PAGE ASSIGNEE SHOULD READ:

-- [73] Assignee: Truth Incorporated, Owatonna, Minn. --.

Signed and Sealed this

Thirtieth Day of August, 1988

*Attest:*

DONALD J. QUIGG

*Attesting Officer*

*Commissioner of Patents and Trademarks*